US007870899B2

(12) United States Patent
Wilson

(10) Patent No.: US 7,870,899 B2
(45) Date of Patent: Jan. 18, 2011

(54) METHOD FOR UTILIZING PRESSURE VARIATIONS AS AN ENERGY SOURCE

(75) Inventor: Dennis R. Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 180 days.

(21) Appl. No.: 11/764,709

(22) Filed: Jun. 18, 2007

(65) Prior Publication Data

US 2008/0308270 A1 Dec. 18, 2008

(51) Int. Cl.
*E21B 43/00* (2006.01)

(52) U.S. Cl. ..... 166/244.1; 166/105; 166/113

(58) Field of Classification Search ..... 166/53, 166/304, 312, 90.1, 305.1, 310; 417/398, 417/399, 401, 403
See application file for complete search history.

(56) References Cited

U.S. PATENT DOCUMENTS

| | | | | |
|---|---|---|---|---|
| 3,090,316 | A | 5/1963 | Montgomery | 103/52 |
| 3,101,090 | A | 8/1963 | Carden | 137/99 |
| 3,901,313 | A | 8/1975 | Doniguian et al. | 166/64 |
| 4,150,721 | A | 4/1979 | Norwood | 166/83 |
| 4,297,087 | A * | 10/1981 | Akkerman | 417/378 |
| 4,352,376 | A | 10/1982 | Norwood | 137/624.15 |
| 4,921,048 | A | 5/1990 | Crow et al. | 166/372 |
| 5,146,991 | A | 9/1992 | Rogers et al. | 166/369 |
| 5,209,301 | A | 5/1993 | Ayres | 166/305.1 |
| 6,343,653 | B1 | 2/2002 | Mason et al. | 166/312 |
| 6,745,838 | B2 | 6/2004 | Watson | 166/310 |
| 7,117,947 | B2 | 10/2006 | Wilson | |
| 2005/0022994 | A1 | 2/2005 | Wilson | 166/305.1 |
| 2005/0150658 | A1 * | 7/2005 | Farris | 166/310 |

FOREIGN PATENT DOCUMENTS

| | | |
|---|---|---|
| EP | 1416118 A1 | 5/2004 |
| WO | WO 8600371 A1 * | 1/1986 |

* cited by examiner

*Primary Examiner*—Kenneth Thompson
*Assistant Examiner*—James G. Sayre

(57) ABSTRACT

The present disclosure relates to a pump mechanism driven by differential pressure conditions and method for delivery of materials. In one embodiment, the pump mechanism may be used to deliver treatment chemical to a plunger apparatus or directly to a wellbore by exploiting pressure conditions found at a well. In certain embodiments, the pump mechanism is able to balance high pressure conditions available within a petroleum formation against low pressure conditions present in a common flow line serving the well. In so balancing these pressures, the pump mechanism is able to automatically tune itself to the needs of the well, ensuring continued operation over a wider range of operating conditions. The pump mechanism has the further advantages of lower operation costs and less environmental impact as compared with existing pumps. The pump mechanism can be used in connection with a chemical applicator which can be used to apply chemical into, onto, or below, a plunger or plunger/dispenser apparatus used in plunger lift operations, or to apply chemical directly down the well. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

10 Claims, 9 Drawing Sheets

METHOD FOR UTILIZING PRESSURE VARIATIONS AS AN ENERGY SOURCE

TECHNICAL FIELD

In one aspect, the present disclosure relates to devices that are energized using pressure variations. In another aspect, the present disclosure relates to methods for utilizing pressure variations to energize devices.

BACKGROUND OF THE DISCLOSURE

A variety of systems and devices may be utilized to carry out hydrocarbon-related operations. These operations may include the drilling and completion of wellbores, recovering hydrocarbons such as oil and gas, transporting hydrocarbons across pipelines and flow lines and processing hydrocarbons. One system used in connection with hydrocarbon-related operations is a chemical treatment system that adds one or more chemicals into a well.

In some wells, and particularly older wells, the lower sections of the production tubing and the well casing as well as the lower areas of the near wellbore formation can become blocked by corrosion, scale, paraffin deposits, deposits of petroleum distillates and other undesirable deposits. These deposits may hinder the production of gas from the well by plugging perforations made in the well casing, thereby preventing the flow of gas into the wellbore. To combat this problem, treatment chemicals may be introduced into the wellbore. These treatment chemicals can include such things as soap, acid, corrosion inhibitors, solvents for paraffin and petroleum distillates, stabilizers and other known treatment chemicals. A number of techniques have been employed to deliver treatment chemicals downhole, most of which require the use of a pump to transfer chemicals from a reservoir to the well head.

One method of treatment is to continuously pump a small amount of treatment chemical into the well during production. The treatment chemical falls to the bottom of the well, where it mixes with other fluids and is drawn up with the liquid lifted by a lifting device. This continuous treatment approach usually requires a conduit, known as a capillary string, which may be banded to the production tubing to deliver the chemical, which may be mixed with water, to the bottom of the well. Mixing chemicals with a small amount of produced fluids and continuously or periodically returning the resulting mixture to the wellbore is another treatment method. Still, another method of chemical delivery is a batch treatment that involves pumping liquid treatment chemicals down the borehole using on a dead space below the perforations to retain residual chemical for a period of time. Finally, as is described in more detail herein, another treatment method involves the application of chemicals directly below, onto, or into, a plunger, and then using the plunger to push or deliver the chemicals down the well.

Conventionally, these methods use a pump to convey a treatment chemical from a supply to its application site. In some configurations, the pumps are powered by electricity or a fuel. Such pumps, which can include electric-powered or diaphragm pumps, may utilize fuel generator sets that introduce or produce exhaust gases that may have a harmful effect on the local environment. Moreover, the operation of pumps utilizing electrical power or combustion may be undesirable in certain environments where electrical sparks or heat may ignite volatile materials. Further, because these pumps can operate for extended periods, electrical energy or fuel must be continuously supplied or replenished. Because hydrocarbon-related operations can occur in relatively remote geographical regions, maintaining a supply of power for these pumps may be burdensome. Thus, chemical treatment operations may be made more efficient if one or more of these pump operating characteristics were minimized or eliminated.

It should be appreciated that the operating characteristics such as undesirable emissions and on-going power supply demands may be associated with numerous other systems and devices used in a variety of hydrocarbon-related operations and also in operations unrelated to the oil and gas industry. Thus, such systems and devices may also be made more efficient if one or more of these operating characteristics were minimized or eliminated.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

SUMMARY OF THE DISCLOSURE

Figure 1:
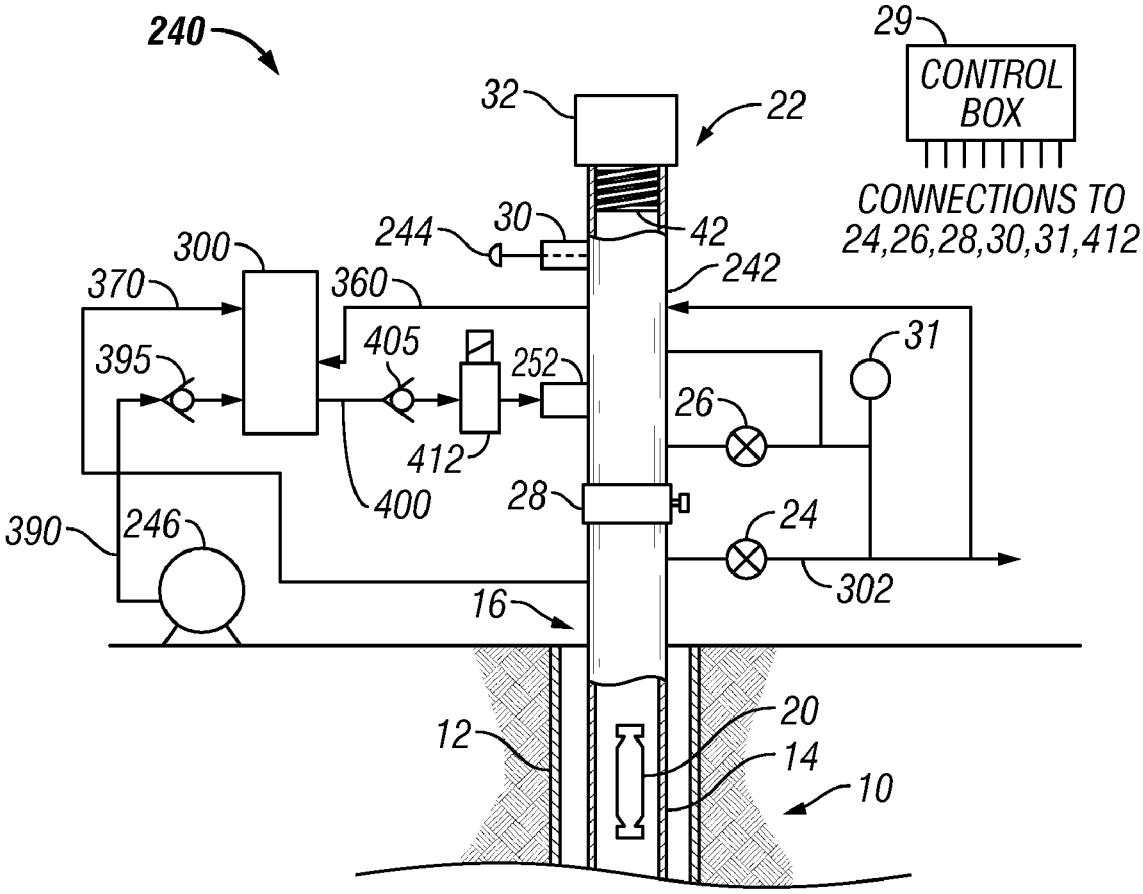
FIG. 1 is a schematic representation of a well utilizing one embodiment of a pump mechanism made in accordance with the present disclosure.

The present disclosure relates to a method and apparatus for transport of materials utilizing a pump mechanism driven by pressure changes, whether naturally occurring or controlled or induced, in an associated pressure source. The pressure swing pump stores energy from a high pressure peak to enable it to pump fluids, chemicals, lubricants, and the like into a positive pressure system. In one embodiment, the present disclosure relates to the delivery of treatment chemicals or fluids into a wellbore, flow line, vessel, gathering system, or gas or fluid transportation line. The present disclosure may introduce chemicals directly into the wellbore, production tubing, annulus between the production tubing and casing, down a capillary string to some point down the wellbore, or apply them below or to a plunger apparatus of the type used in artificial lift techniques. More specifically, the disclosure relates to a pump mechanism suitable for transporting treatment chemicals, fluids, and lubricants, and which is powered by changes in the pressure of a wellbore, vessel, or line to which the pump is fluidly connected. In one embodiment of the method of the present disclosure, the pump is used to draw treatment chemical, fluid, or lubricant, from a storage container, and thereafter pump the chemical, fluid, or lubricant, either directly into the wellbore, line or vessel or other apparatus. When the current disclosure is used to deliver materials for plunger application, the materials are applied below, onto, or inside the plunger for delivery by the plunger to the wellbore. At predetermined times when the plunger returns to the surface, additional treatment chemical can be applied below, onto, or inside the plunger before it descends the wellbore.

In another aspect, the present disclosure relates to a pump mechanism which is powered by the buildup of pressure that naturally occurs within a wellbore during periods when the wellhead is closed, or in a line or vessel when a valve is closed. Specifically, the pump uses the buildup of pressure to power one or more pistons which draw treatment chemicals from a supply into a chamber which may or may not be internal to the pump. Once a predetermined amount of treatment chemical has been drawn from the supply, the flow of treatment chemical is halted, and the pump is considered "charged." Once charged, the pump can be manually discharged, set to "automatically" discharge fluids, chemicals, or lubricants, when the well, vessel, or line, pressure drops below charge pressure, or an automated system operating under predetermined parameters may then discharge the pump and release the treatment chemicals at an advantageous time so that the maximum benefit of the treatment chemicals is realized. For example, in a system where chemicals are applied directly into, onto, or under a plunger, an advantageous time for chemical release may be when the plunger has been retained by a plunger catcher within a manifold located at the wellhead.

In another aspect of the present disclosure, the pump mechanism may rely on the low pressure gas present in the well or low pressure flowing conditions in the flow line during periods when the wellhead or line is open to automatically "reset" the pump mechanism. The pump mechanism may also incorporate a spring, confined gas chamber, and compensation chamber which may be used alone or in combination during low pressure conditions to reset the pump.

In another aspect, the disclosure relates to a chemical application apparatus. The apparatus is a modification to manifold systems used in plunger lift operations. In this embodiment an applicator is positioned in the section of the manifold which receives the delivery system, e.g., plunger, plunger/dispenser apparatus, or plunger with attached chemical dispenser. The applicator is positioned such that it will be operatively adjacent to the receptacle portion of the plunger, plunger/dispenser or chemical dispenser attached to a plunger. The nature of the applicator can vary depending upon the form in which the chemical is utilized. Treatment chemical is provided to the applicator by the pump mechanism.

The disclosure also includes a method for using the pump mechanism to apply treatment chemicals as needed. In one aspect, this method involves catching the plunger or chemical delivery system in a manifold and using the pump to apply chemical into, onto, or below, the assembly without removing the assembly from the manifold.

The automated application of materials such as treatment chemicals in small amounts may be desirable. The current disclosure has the ability to automatically function with each pressure swing to deliver an adjustable amount of treatment chemical. Thus, the pumping mechanism of the present disclosure may also include one or more mechanisms for adjusting the amount of material drawn into the pump and thereafter delivered by limiting travel of the pistons enclosed within the pump.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

DETAILED DESCRIPTION OF THE DISCLOSURE

The present disclosure relates to methods for utilizing pressure variations as an energy source and devices employing such methods. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

The embodiments of systems and methods described herein may find use in any number of applications or environments wherein a source exhibiting pressure variations is available to operate as an energy source. In the oil and gas producing industry, for example, available variable pressure sources may be used to energize a pump mechanism that delivers materials such as treatment chemicals, fluids, and/or lubricants into a selected location such as a wellbore, a production flow line, a subsea flow line, a fluid or gas transportation line, a collection tank, etc. Such pumps may also be used to convey materials into equipment such as valves, gears, linkages and other equipment utilized in vessels, offshore facilities, surface and subsea gathering facilities, or transportation system. While embodiments of the present disclosure may find a wide range of uses, merely for clarity, the following detailed description refer to pump mechanisms used in the delivery of treatment chemicals to a gas well using a plunger lift technique. However, it is emphasized that such pump mechanisms are a non-limiting embodiment of the present disclosure and thus should not be taken as a limitation on the applicability of the teachings of the present disclosure to other situations.

For purposes of background, an abbreviated discussion of the plunger lift technique will be presented. Those skilled in the art will recognize that there are many variations which have been used in connection with the lift technique and system which is described below. The embodiments of the disclosure described may be modified for variations of the described lift system. Further, those skilled in the art will appreciate that the present disclosure need not be used to the exclusion of other chemical treatment methods. Costs and other considerations can result in the use of the present disclosure together with other treatment methods.

Referring to FIG. 1, there is shown a hydrocarbon producing well having a wellbore 10 which typically contains a casing 12 either throughout the entire bore or a portion of the wellbore. The wellbore 10 may also contain a production tubing 14 within the casing 12. In a typical arrangement, the produced fluids flow through the tubing 14 to the wellhead 16. For gas lift operations, a plunger 20 travels in the tubing 14 between a bottom end of the tubing 14 and the wellhead 16. The well may also includes a chemical application system 240. In one arrangement, a manifold 22 is provided at the wellhead 16, which can have a plunger catch 30 to hold the plunger 20 in place, and one or more lubricators 32. Sensors may be distributed throughout the system to provide an indication of parameters and conditions, such as pressure, temperature, flow rates, etc. A representative sensor or meter has been shown with numeral 31. A control box 29 may be programmed to control the flow of gas and liquid from the well by operating valves 24, 26, 28, to control the operation of plunger catcher 30, to receive measurements from sensors and meters such as sensor 31, as well as to perform other functions discussed below. A section of conduit 242 of manifold 22 below the lubricator 32 receives the plunger 20 which is caught by plunger catcher 30. Plunger catcher 30 has a movable pin 244 which may engage a neck on the plunger 20. When it is desired to release the plunger 20, pin 244 is retracted to allow the plunger 20 to fall. Designs and construction of plunger catchers are well known in the art. Furthermore, the use of electronic control boxes to automatically regulate various well operations, such as opening and closing the well to control the flow of gas and liquid, timing the catching and release of the plunger 20, applying treatment chemicals, and the like, is well known in the art. U.S. Pat. No. 4,921,048 titled "Well Production Optimizing System" to Crow, et al., which is hereby incorporated by reference for all purposes, provides an example of such a system. Further information regarding plunger lift operations and related electronic controls is widely available. An example of plunger lift technique may be found in U.S. Pat. No. 3,090,316 entitled "Gas Lifting System." An alternate technique involves the use of a bypass plunger which is designed so as not to require the well to be shut in. U.S. Pat. No. 6,209,637 entitled "Plunger Lift with Multi Piston and Method" relates to this technique. Selecting a control box to accommodate the needs of a particular application is a skill also known in the art.

Chemical application system 240 may also include a chemical storage reservoir 246 which is connected by conduit 390 to a pump mechanism 300. As will be discussed below, treatment chemical may be applied by pump mechanism 300 into the manifold 22 via an applicator 252. Applicator 252 can include a nozzle, an open end of conduit, an atomizer that sprays a chemical on an exterior of a plunger 20 or other such flow device. The selection of the specific applicator will be made taking into account the physical characteristics of the form of the treatment chemical.

In some embodiments, the chemical application system 240 does not utilize a plunger 20 as a carrier of treatment chemical. Rather, treatment chemical may be discharged directly into the wellbore 10. In other embodiments, the plunger 20 or other suitable chemical carrier may be extracted from manifold 22, inspected and recharged with the treatment chemical. Embodiments of the pump mechanisms described herein may be utilized in connection with each of these variants, or any combination of these variants.

Plunger 20 may be of any of the numerous designs which are known in the art or another delivery system as described herein. The plunger 20 provides a mechanical interface between the gas and the liquid present in the well and may be used to expel liquids such as water from the wellbore 10. During operation, the accumulation of liquids in the wellbore 10 may cause the pressure in the wellbore 10 to drop sufficiently to restrict or stop the flow of desired hydrocarbons. To restore wellbore pressure, the well is shut-in. To initiate a well shut in, controller 29 signals the plunger catcher 30 to pull back pin 244, thereby releasing the plunger 20 to fall toward the bottom of the well. As plunger 20 falls, fluid will pass around plunger 20 through a space left between plunger 20 and tubing 14 or through passageways (not shown) within plunger 20. Because the well is shut in, formation gases flowing into the wellbore 10 cause gas pressure to build in the well. When the well is opened, the built-up gas pressure will push plunger 20 and the liquid on top of the plunger 20 up tubing 14 to the surface.

It should be appreciated that the pressure in the well swings or cycles between a low pressure at a time proximate to well shut-in and a high pressure proximate to well opening. In this aspect, the well is illustrative of a source having pressure variations or fluctuations.

Figure 6:
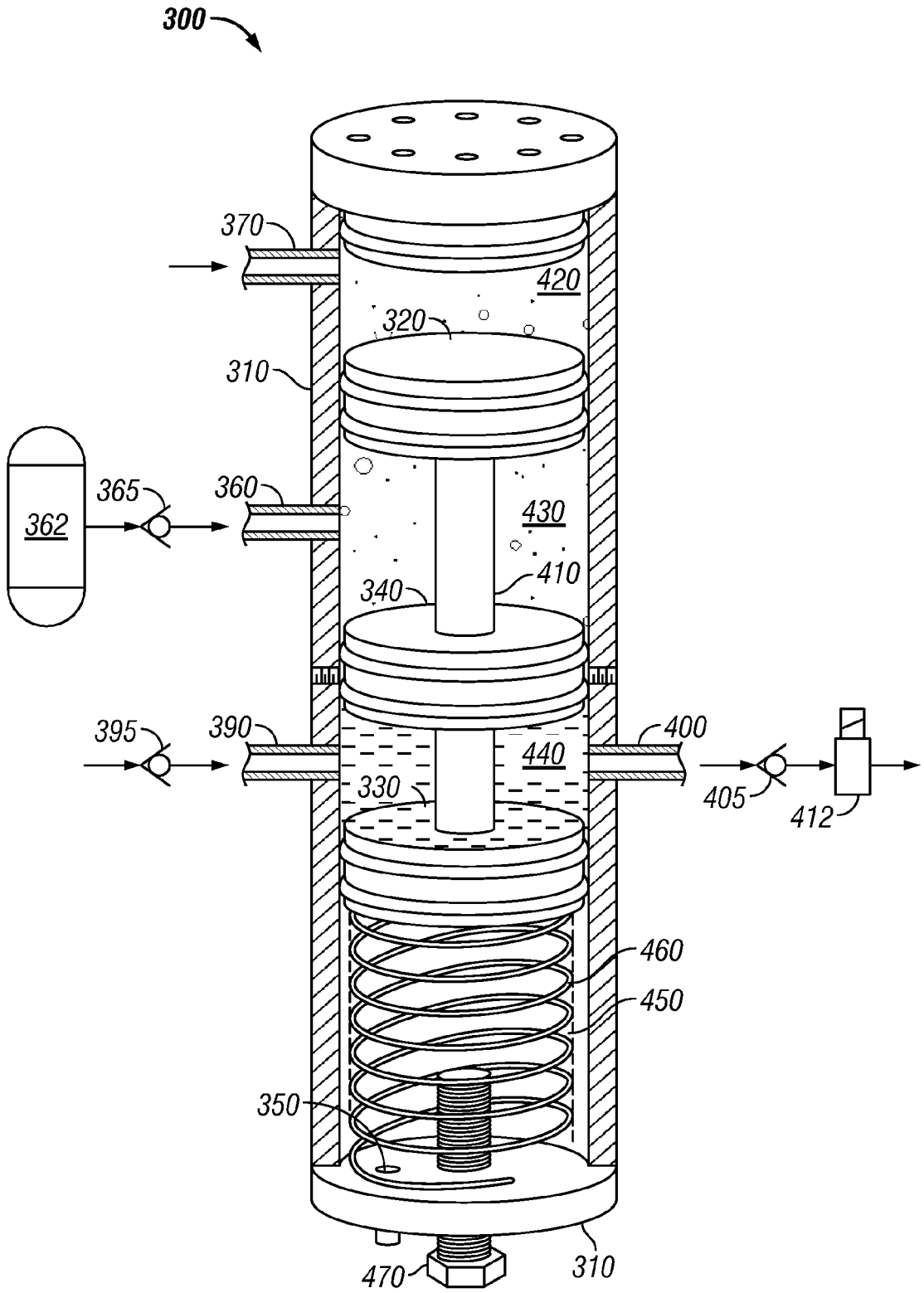
FIG. 6 is a cross-sectional view of one embodiment of a pump mechanism made in accordance with the present disclosure.

Referring now to FIG. 6, there is shown one embodiment of a pump mechanism 300 that may be energized using pressure variations associated with the well. In one embodiment, pump mechanism 300 is generally cylindrical, although those skilled in the art will recognize that other shapes are acceptable. Pump mechanism 300 may be comprised of housing 310, first piston 320 which is fixedly connected to second piston 330 by connecting rod 410, pump divider 340, and may also include one or more vents 350. Pump mechanism 300 may be in fluid communication with a number of flow lines such as, in the embodiment herein depicted, lines 360, 370, 390, and 400. Directional check valves 395 and 405 may be incorporated into lines in fluid communication with pump mechanism 300 to ensure a desired direction of flow. The particular placement of check valves 395 and 405 depicted in FIG. 1 is not intended to limit the placement of these valves. Pistons 320 and 330 are sized such that they create a fluid tight seal with the interior surface of housing 310. Those skilled in the art will recognize that the addition of piston rings, a cylinder sleeve or other mechanism for improving the seal between the pistons and housing 310 are known in the art and their use herein would not deviate from the scope of the disclosure. Pistons 320 and 330 are free to move linearly within pump mechanism 300, generally along the axis of pump mechanism 300 in embodiments wherein pump mechanism 300 is cylindrical. Pump divider 340 is fixedly mounted to housing 310 such that it creates an airtight seal dividing at least a portion of the interior volume of pump mechanism 300. Furthermore, pump divider 340 is constructed such that connecting rod 410 is able to pass through it, yet a substantially airtight seal is maintained between pump divider 340 and connecting rod 410. Pistons 320 and 330 and pump divider 340 act to divide the interior volume of pump mechanism 300, thereby creating a high pressure gas chamber 420, a low pressure chamber 430, a treatment chemical chamber 440, and an ambient chamber 450.

Referring now to FIGS. 1 and 6, flow lines 360 and 370 provide pressure communication with pressure sources. Fluid line 390 connects pump mechanism 300 with chemical supply 246 and fluid line 400 connect pump mechanism 300 with applicator 252. Directional check valves 395 and 405 are used to control the flow of treatment chemical into and out of pump mechanism 300. Lines 360, 370, 390 and 400 may use conduits known in the art such as flexible tubing, braided steel lines, rigid piping and the like. In one embodiment, line 360 is in fluid communication with a source of produced petroleum which is at a relatively low pressure in the well cycle such as the flow line pressure down stream of shut in valve 28, and more particularly, such as at flow line 302 associated with the particular well. Regardless of the point where line 360 is connected, in a preferred embodiment, such connection will be at a point at which liquid entry into pump mechanism 300 may be avoided.

Optionally, the line 360 may be in fluid communication with gas charging source 362 (FIG. 6)such as a methane or nitrogen supply. In this optional arrangement, check valve 365 may be added to prevent flow back of gas to the supply. In general, it may be preferable to maintain the pressure of the gas charging source at a level which is approximately equal to the pressure found in flow line 302. This embodiment may be preferable in applications wherein the pressure within the well is relatively constant and/or if opening and closing of the well is not automatic. Conversely, in applications wherein pressure within the well is not relatively constant, and/or opening and closing of the well is carried out by a timed schedule, then it may be beneficial to connect line 360 to a source of produced petroleum in a manner that low pressure may be conveyed to pump mechanism 300. Further, in some embodiments, a gas charging source 362 may be used in conjunction with a connection to the source of produced petroleum. In one embodiment, as the volume of low pressure chamber 430 decreases, the gas present in that chamber is forced back through line 360 and into flow line 302, maintaining the pressure in low pressure chamber 430 at the pressure of the flow line 302. Alternatively, check valve 365 may be provided in line 360 as shown in FIG. 6 may prevent the flow of charging gas out of low pressure chamber 430 and therefore cause pressure within low pressure chamber 430 to rise.

Referring now to FIGS. 1 and 6, line 370 is in pressure communication with a high pressure source of produced gas such as the wellhead itself. The pressure provided by the high pressure source may be constant or variable. Line 370 may be connected in such a way that entry of liquid into pump mechanism 300 may be avoided. Line 390 is in fluid communication with chemical storage reservoir 246 while check valve 395 is placed in line 390 to allow flow of chemical into, but not out of, pump mechanism 300. Line 400 is in fluid communication with the desired destination for the treatment chemical, whether that is directly down the wellbore through the casing annulus, tubing or both, or whether the treatment chemical is applied to plunger 20 via applicator 252. Check valve 405 and solenoid valve 412 may both be placed in line 400 to regulate the flow of treatment chemical from pump mechanism 300. In alternate embodiments, solenoid valve 412 may be excluded, allowing pump mechanism 300 to cycle automatically and discharge treatment chemical with changes in pressure within the well. A vent 350 may be provided to equalize pressure between ambient chamber 450 and the atmosphere. While one spring element is shown, two or more springs, each of which have the same or different spring constants, may be utilized. Additionally, suitable biasing member may also include compressible fluids.

Referring now to FIG. 6, a biasing member such as a spring 460 may be installed within pump mechanism 300 to bias pistons 320, 330 and connecting rod 410 toward a preferred direction of travel. In one arrangement, spring 460 is installed in ambient chamber 450 such that it tends to urge pistons 320, 330 and connecting rod 410 to an "uncharged state." Spring tension may be set such that treatment chemical will be discharged from treatment chemical chamber 440 at a rate desired by the operator. In embodiments, spring tension may be adjustable such that an operator may adjust the rate of treatment chemical discharge. One skilled in the art will also recognize that altering spring locations and/or altering the anchoring point of spring 460 so as to use energy stored either in spring compression or spring tension may accomplish the same result. Furthermore, alternate means for biasing pistons 320, 330 and connecting rod 410 in one direction or the other, such as by advantageously weighting pistons 320, 330 and connecting rod 410, or by the physical orientation of pump mechanism 300 at installation, may accomplish the same result.

Referring still to FIG. 6, a stop 470 may be provided within ambient chamber 450 and may be used to set the maximum volume of treatment chemical chamber 440 by limiting the distance pistons 320, 330 and connecting rod 410 are allowed to travel. Stop 470 may be placed in different locations within pump mechanism 300, and that other methods of arresting piston travel such as a tether (not shown) or a series of protrusions (not shown) extending radially inward from housing 310, may be included without deviating from the scope of the disclosure. In one embodiment, stop 470 is a threaded rod which extends through housing 310 so that a user may vary the length of stop 470 that extends inside ambient chamber 450. By so doing, the user may vary the distance pistons 320, 330 and connecting rod 410 are allowed to travel, and consequently the maximum volume of treatment chemical chamber 440. In an alternate embodiment, stop 470 may be automatically or remotely adjustable such as by connection to control box 29 or to any other known control system. By so doing, an operator may vary the volume of treatment chemical chamber 440 without actually visiting the well site, or the volume of treatment chemical chamber 440 may be automatically adjusted in response to one or more sensor inputs or to a pre-set schedule.

As shown in FIG. 6, pump mechanism 300 is in the resting or "uncharged" state. In this state, piston 320 is located adjacent to the top of housing 310, and piston 330 is adjacent to pump divider 340. The volume of chambers 420 and 440 is minimized in this state. High pressure chamber 420 is in fluid communication with the wellhead via line 370 and thus pressure within high pressure chamber 420 may be substantially equal to the pressure at the wellhead. In the embodiment depicted in FIG. 6, low pressure chamber 430 is in fluid communication with a low pressure source such as the flow line 302, resulting in the pressure within low pressure chamber 430 being substantially equal to the flow line pressure down stream of shut in valve 28. Optionally, line 360 may connect low pressure chamber 430 with gas charging source 362, thus, in that embodiment, pressure within low pressure chamber 430 would be controlled by the pressure supplied from gas charging source 362.

Figure 7B:
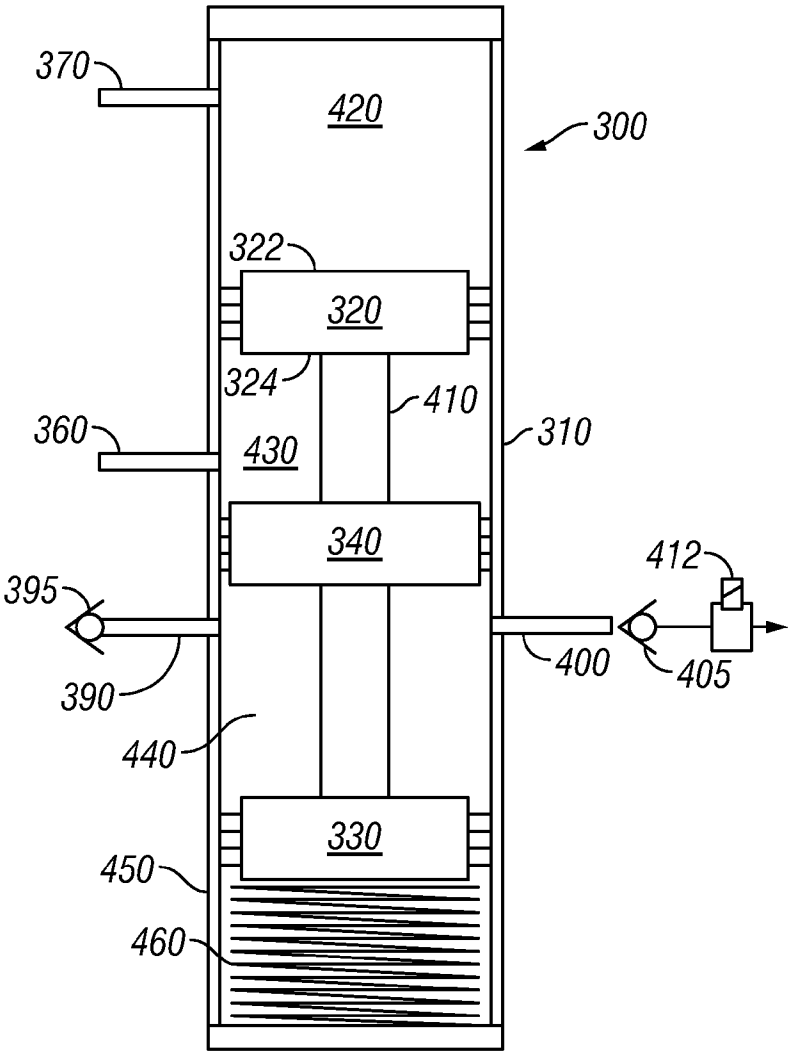
FIGS. 7A and 7B respectively schematically illustrate an uncharged and charged state of one embodiment of a pump mechanism made in accordance with the present disclosure.
Figure 7A:
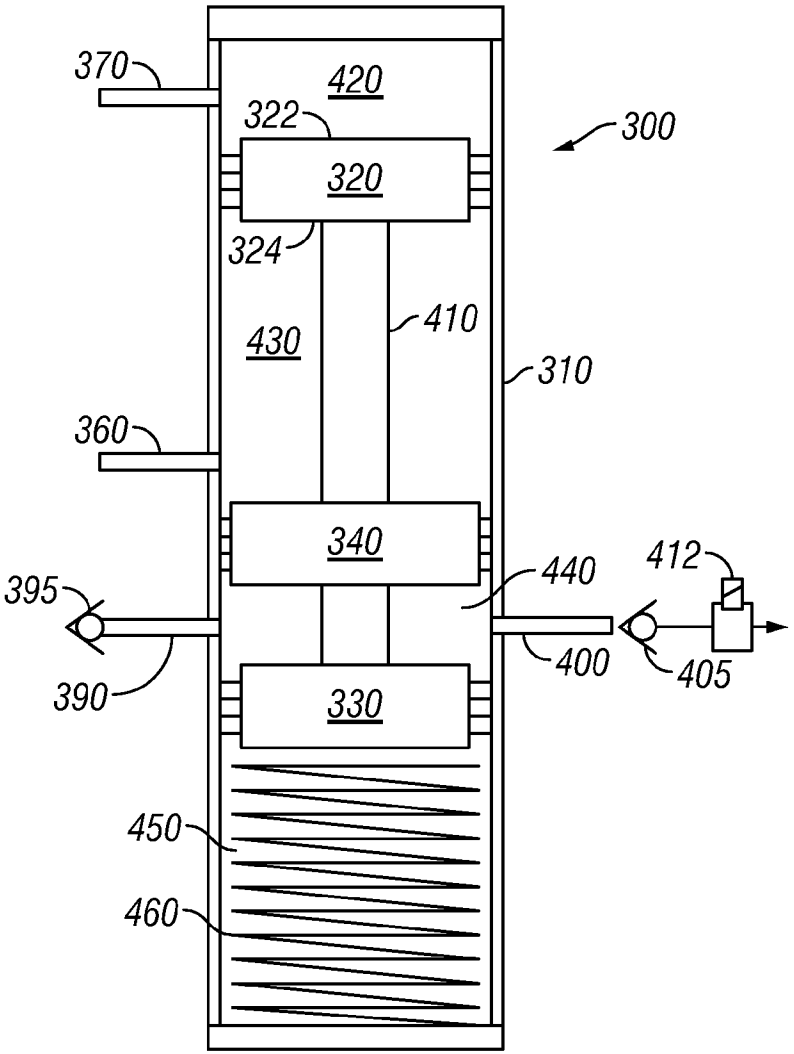

Referring now to FIGS. 7A and 7B, there are shown the pump mechanism 300 in an uncharged and charged state, respectively.

FIG. 7A schematically illustrates the positions of pistons 320 and 330 during a period of low pressure in the well while the well is open. Because the well, which is the source providing pressure variations in this instance, is at a low pressure, the flow line 370 does not communicate a pressure to the chamber 420 that when applied to a face 322 of piston 320 is of sufficient magnitude to overcome the pressure in chamber 430 and/or the spring force of spring 460. The fluid in low pressure chamber 430 applies a pressure to a face 324 of piston 320. Thus, the pressure in chamber 430 and/or the spring 460 urge the pistons 320 and 330 to a position that result in both chamber 420 and chamber 440 have relatively small volumes.

As pressure in the wellbore increases, either through natural cycling or resulting from procedures performed on well 10 such as, for example, closing the well, the well transitions from a low pressure condition to a high pressure condition.

FIG. 7B schematically illustrates the position of pistons 320 and 330 during a period of high pressure in the well such as after the well has been shut-in. The pressure increase in the well is transmitted via line 370 to high pressure chamber 420, which causes an increased applied pressure on face 322 of the piston 320. Once the applied pressure has risen sufficiently to overcome the pressure in low pressure chamber 430 and/or the spring force supplied by spring 460, pistons 320 and 330 are displaced in a manner that causes the volumes of high pressure chamber 420 and treatment chemical chamber 440 to expand. For example, piston 320 moves toward pump divider 340 and piston 330 moves toward the bottom of housing 310. The expansion of the volume of treatment chemical chamber 440 reduces the pressure in the treatment chemical chamber 440, which causes treatment chemical to be drawn into treatment chemical chamber 440 via line 390. Once treatment chemical or other material has been drawn into treatment chemical chamber 440, pump mechanism 300 is in the charged state and is ready to deliver treatment chemical to well 10. Simultaneously, the movement of piston 330 may compress spring 460 and/or compress the gas in low pressure chamber 430 provided by low pressure source 362 (FIG. 6). The compression of spring 460 and/or gas in low pressure chamber 420 may store energy that may be used to perform work upon release of the pressure within high pressure gas chamber 420 via line 370.

To initiate the delivery of the material in the treatment chemical chamber 440, the high pressure fluid in chamber 420 is vented via line 370. Thereafter, the solenoid valve 412 or other suitable flow control device is actuated by the control box 29 (FIG. 1) to an open position. With the pressure in high pressure chamber 420 reduced, the spring force stored in spring 460, and/or gas pressure stored in low pressure chamber 430 will be sufficient to drive pistons 320 and 330 back to positions associated with the uncharged state as shown in FIG. 7A. The movement of piston 330 reduces the volume of chemical treatment chamber 440, which causes the material in the chemical treatment chamber 440 to be expelled out line 400 and through open solenoid valve 412.

In one mode of operation, rather than allowing pressure to slowly build within high pressure gas chamber 420, which causes a relatively slow movement of pistons 320, 330 and connecting rod 410, a sudden exposure to the high pressure source may result in a relatively rapid movement of these elements. The relatively rapid movement may serve to create a more severe pressure imbalance between treatment chemical chamber 440 and chemical storage reservoir 246 (FIG. 1). This increased imbalance may be desirable in situations wherein the chemical to be moved is heavy or viscous and the gradual creation of the low pressure condition in treatment chemical chamber 440 may be insufficient to move such a chemical. This embodiment may also be useful if the treatment chemical is in the form of pellets.

Figure 7D:
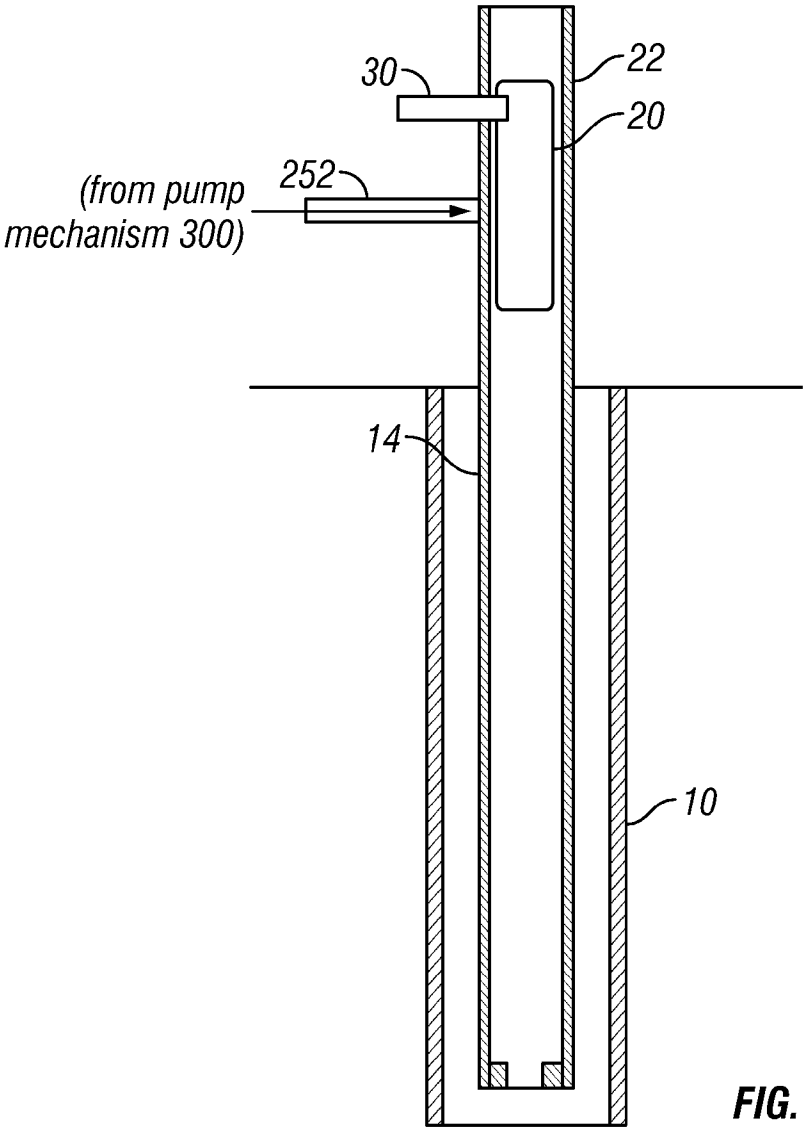
FIGS. 7C and 7D respectively schematically illustrate a bottom and top position of one embodiment of a plunger utilized in connection with embodiments of the present disclosure.
Figure 7C:
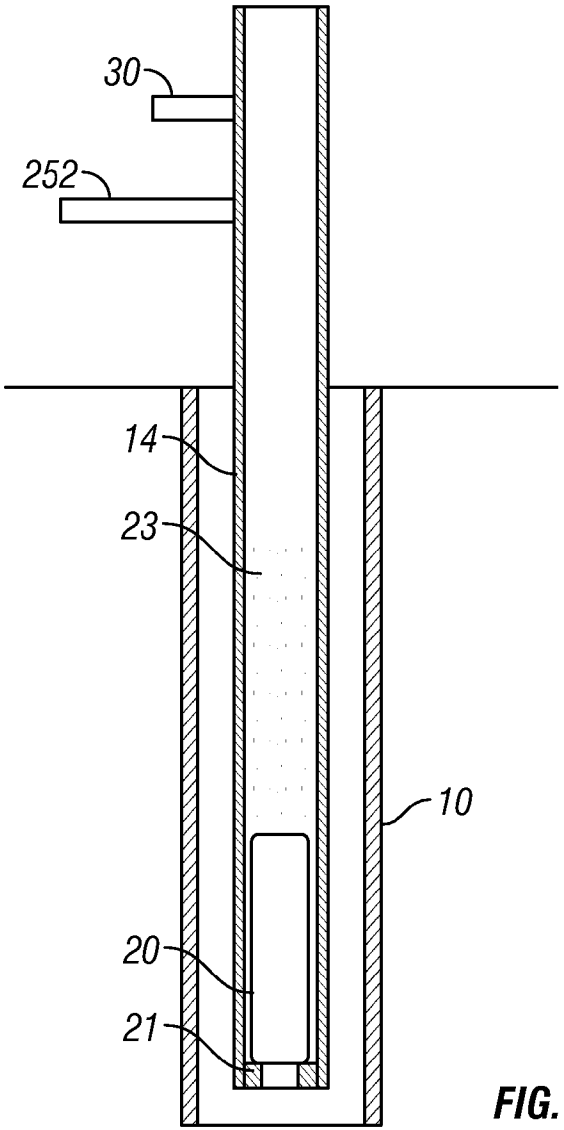

FIGS. 7C and 7D schematically illustrate the positions of the plunger 20 at the low pressure and high pressure conditions associated with the pressure variations in the wellbore 10, respectively.

Referring to FIGS. 1 and 7C, at a low pressure condition, the plunger 20 bottoms on a stop or landing nipple 21 at a bottom end of the production tubular 14. The position of the plunger 20 as shown in FIG. 7C thus is generally contemporaneous with the uncharged state of the pump mechanism 300 shown in FIG. 7A. In this bottom position, the treatment chemicals carried by the plunger 20 leach or dissolve into the surrounding wellbore fluids. As can be seen, a column or slug of fluid 23 such as water rises above the plunger 20. While pump mechanism 300 is charging as described above, the pressure within the formation builds pressure behind plunger 20 so that once the well is re-opened, the plunger 20 will be propelled to the top of the wellbore 10 carrying with it the fluid slug 23.

Referring to FIGS. 1 and 7D, when the plunger 20 reaches the top of the well it enters or is received by the manifold 22 while the undesirable fluids are discharged. Manifold 22 can include a shock absorbing spring 42 or other mechanism to reduce the impact of the plunger 20. Appropriate sensors are provided to detect arrival of plunger 20 at the surface and to activate plunger catch 30 which holds plunger 20 until a signal is received to release it. Control box 29 may contain circuitry for opening and closing the appropriate valves 24, 26, and 28 during the different phases of the lift process, for opening and closing solenoid valve 412 and for releasing the plunger 20 to return to the bottom of the tubing 14 by controlling plunger catcher 30. For example, once the control box 29 senses, either through physical sensors detecting a full condition, or by a preset timed schedule, that pump mechanism 300 is charged and that it is appropriate to discharge treatment chemical, it may open solenoid valve 412. This action initiates a number of simultaneous events. Gas in high pressure gas chamber 420 is forced back into line 370 as at this point in the cycle, the pressure in the high pressure source is low. In a manner previously described, the opening on solenoid valve 412 allows pump mechanism 300 to make use of the energy stored in the compressed gas within pump low pressure chamber 430 and/or spring 460 to deliver treatment chemical via line 400 either directly down the wellbore or to plunger 20 through chemical applicator 252.

In embodiments utilizing plunger 20, once treatment chemical has been discharged, control box 29 may be programmed to determine when it would be advantageous to close the well and to release plunger 20. It is known in the art to close a well, thereby creating a buildup of pressure within the formation, either by monitoring flow from the wellbore and closing the well once the flow drops below a predetermined level, or on a simple timed schedule. Regardless of the method used, once the well has been shut-in, control box 29 may then signal plunger catcher 30 to immediately release plunger 20, or to wait a predetermined period of time before releasing plunger 20. In arrangements utilizing a delay or a waiting period before releasing plunger 20, fluid have time to build up within the wellbore to slow the descent of plunger 20 and thereby reduce the potential for damage to plunger 20 that would be expected if it were allowed to fall unimpeded to the bottom of the wellbore. However, consideration must also be given to the fact that any fluid encountered by the plunger 20 during the decent may wash some treatment chemical from plunger 20. This may be an undesired result as it may be advantageous to deliver the entire load of treatment chemical to the bottom of the well. The timing of the release of plunger 20 may be specific to each application depending on the desired application, the treatment chemical used, its method of application, and the rate of flow of fluid into the well, however, those skilled in the art will recognize that well operators are knowledgeable of these variables and are able to make the determination as to when to release plunger 20 based on their experience in the industry and with the specific well.

As described above, plunger 20 and its associated apparatus may be omitted in favor of directly discharging treatment chemical down the wellbore 10. In such an arrangement, control box 29 determines when sufficient chemical has been drawn into treatment chemical chamber 440, and determines when it would be most advantageous to release the treatment chemical into the wellbore. In one embodiment, treatment chemical is released immediately after the well is shut in. This timing is advantageous for a number of reasons. First, when the well is shut in, there is no flow outward from the wellbore. Thus, treatment chemical released into the wellbore will be allowed sufficient time to flow to the bottom of the wellbore without the risk of the chemical being flushed out by the outward flow of petroleum or other fluids in the well. Second, releasing the treatment chemical returns pump mechanism 300 to its "uncharged" state. By releasing the chemical immediately upon shut in and returning the pump to the uncharged state, the pump is placed in position to begin the charging cycle again at the same time that the well is again beginning to build pressure.

Once treatment chemical has been discharged and in embodiments wherein low pressure chamber 430 is fluidly connected to a low pressure gas source such as flow line 302, this connection serves to tune the pump mechanism to the needs of the particular formation. Specifically, charging pump low pressure chamber 430 with a low pressure gas source such as flow line 302 provides a mechanism that can automatically tune itself to the needs of a particular application by varying the level of pressure in pump low pressure chamber 430. In so doing, pump mechanism 300 ensures continued operation regardless of any variation in the level of pressure in the formation which, because of the fluid connection between the formation and high pressure gas chamber 420, causes variations in the amount of pressure available to operate pump mechanism 300.

Unless actions are run from a simple timed schedule, the points at which a well is shut-in and opened are related to the pressure available in the formation as well as the pressure present in the flow line, which may be generally a relatively constant pressure. Typically, once a well has been shut-in, it will not be re-opened until the pressure in the formation has built to between 1.5 and 2.5 times the pressure in the flow line, although variations in this level may be possible. Thus, the maximum amount of pressure available to high pressure gas chamber 420 may range approximately between 1.5 and 2.5 times greater than the pressure present in pump low pressure chamber 430. It may be advantageous to balance high pressure gas chamber 420 against pump low pressure chamber 430 in this manner to ensure that pump mechanism 300 does not become biased in either the charged or uncharged states. In other words, if pump low pressure chamber 430 were not charged with low pressure gas, and instead mechanical means such as a spring 460 were used to return pistons 320, 330 and connecting rod 410 back to the "uncharged" state, the pressure available to fill high pressure gas chamber 420 may not be sufficient to overcome spring 460, which may then inhibit operation of the pump. By ensuring that high pressure gas chamber 420 need only work against the low pressure gas present in pump low pressure chamber 430, there is a greater likelihood that the pump will continue to function substantially independent of the pressures present in the formation and/or the flow line 360. As discussed above, in certain applications, such as where the level of pressure available in the formation is relatively constant, thereby eliminating or reducing the need for tuning, it may be advantageous to use a gas charging source 362 to provide a constant level of pressure to low pressure chamber 430.

In embodiments wherein low pressure gas chamber 430 is eliminated and the work of returning pump mechanism 300 to the uncharged state is left to spring 460 or to preferential weighting or orientation of pistons 320, 330 and connecting rod 410, pump mechanism 300 may nevertheless function, especially if used in applications where the pressure in the formation and the flow line are known and remain relatively constant. That is, in those applications, it is possible to select a spring 460, weights or an orientation which will be overcome by the pressure available to high pressure gas chamber 420 at a rate which is satisfactory to the operator.

As should be appreciated, pump mechanism 300 may be used to introduce treatment materials, such as chemicals, into a wellbore or flow line and may be energized by pressure swings or changes within the wellbore resulting from opening and shutting the wellhead or valve or choke or by other controlled variations in pressure. The pressure swings may also be naturally occurring pressure. The use of pressure swings or changes within the wellbore or flow line to power the pump reduces the need for external power sources, and reduces the environmental impact of the pump by reducing hazards and emissions from the pump and by reducing the footprint of the well. Moreover, the use of a pump which is not powered by the combustion of hydrocarbons or exhausting of hydrocarbons may reduce the risk of fire at the well. Also, in certain embodiments of the present disclosure, the pump is able to automatically adjust to changing pressure conditions within the well, thereby assuring continued operation in spite of variable operating conditions. Thus, embodiments of the current disclosure may be considered as economical due to the reduced need for additional equipment and reduced need for external power such as electrical power or fuel such as petroleum produced from the well.

Figure 2:
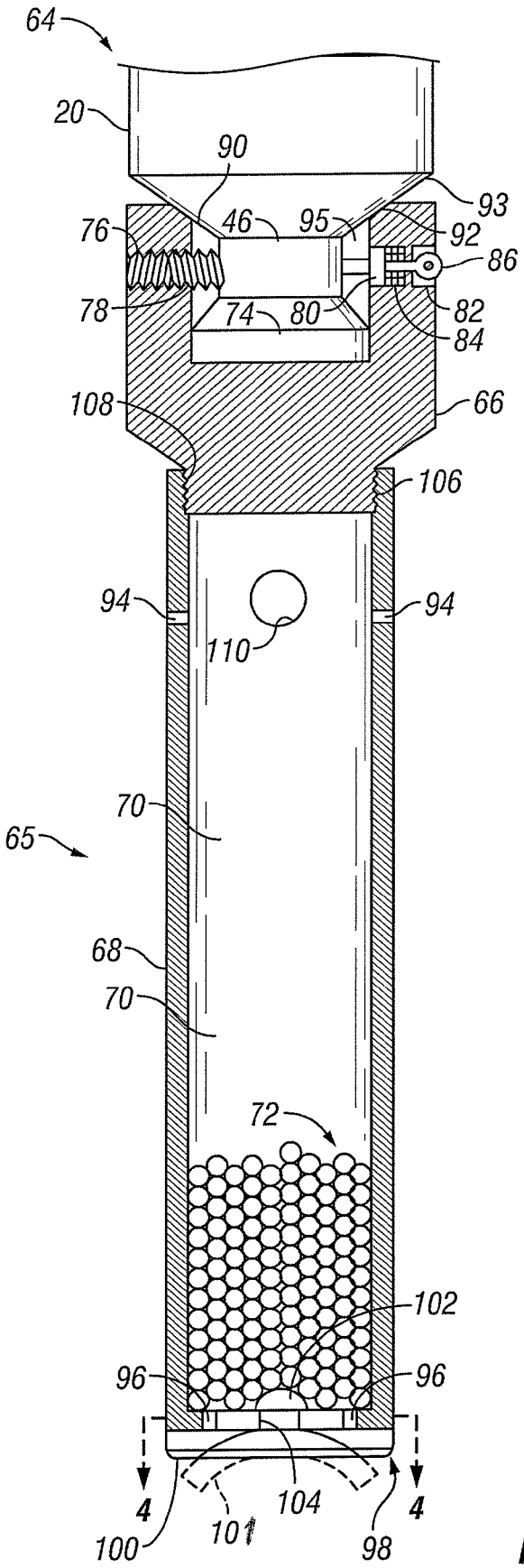
FIG. 2 is a cross-sectional view of one embodiment of a chemical dispenser.

Referring now to FIG. 2, there is shown a chemical delivery system 64 that may be used to deliver one or more selected materials such as treatment chemicals into the well. Only a lower portion of plunger 20 is shown. The system 64 includes a plunger 20 with an attached chemical dispenser 65. The plunger 20 may be of any suitable design and may have a neck 46 on the lower end. Chemical dispenser 65 has a head portion 66 and a member 68 which defines a receptacle 70 for receiving a selected material 72 such as treatment chemical. Head 66 defines an opening 95 to receive the lower portion of plunger 20 and the plunger neck 46. Head 66 includes attachment mechanism for attaching the dispenser 64 to the plunger 20. One attachment mechanism may include a set screw 76 in threaded passageway 78 in head 66. Another attachment mechanism may include a spring loaded bolt 80 in passageway 82. A spring 84 biases the bolt 80 against the neck 46 of the plunger 20. A ridge 86 can be provided in the passageway 82 against which the spring 84 rests. To remove the head 66 the bolt 80 and screw 76 are retracted. For purposes of illustration two different attachment mechanisms are shown in FIG. 2. Typically one or more of the same attachment mechanisms will be utilized, for example, one or more set screws 76, one or more bolts 80, rather than having a mixture of different types of attachment mechanisms.

Ports are provided in receptacle 70 to control flow through the receptacle 70. For example, one or more upper ports 94 and one or more lower ports 96 are used to allow gas and liquid to enter or leave the receptacle 70. Additionally, a valve 98 may be provided to further control fluid flow into and out of receptacle 70. In the illustrated embodiment, valve 98 is a flexible rubber sheet 100 having a dimension sufficient to cover lower ports 96. Valve 98 is held in place by a retaining plug 102 which can extend through an opening 104 in the bottom of the member 68. The purpose of valve 98 is to either restrict or close off the flow of liquid through lower ports 96 as the plunger 20 drops. As the plunger 20 drops in the tubing, the flexible sheet 100 will be pushed against the bottom of the member 68. This will either completely seal or partially seal off ports 96. The purpose of valve 98 is to minimize or prevent the flow of fluid through receptacle 70 while the system drops in the tubing. This will prevent or minimize the washing of chemicals out of the receptacle as the chemical dispenser 65 passes through the fluid above the stop of the tubing. Once the delivery system 64 comes to rest on the stop, flexible sheet 100 will fall away from the bottom of member 68 and to a second position 101 (shown in phantom), because there is no force pushing the flexible sheet 100 against the bottom of member 68. This will allow liquid to enter receptacle 70 and leach the treatment chemical 72 out of receptacle 70.

Chemical delivery system may include a threaded surface 106 on the bottom of head 66 to engage a threaded surface 108 on member 68. This allows member 68 to be removed from head 66 for the insertion of chemicals into the receptacle 70. Alternatively, head 66 and member 68 can be one piece and an opening 110 provided through which chemicals can be inserted into the receptacle 70.

Figure 3:
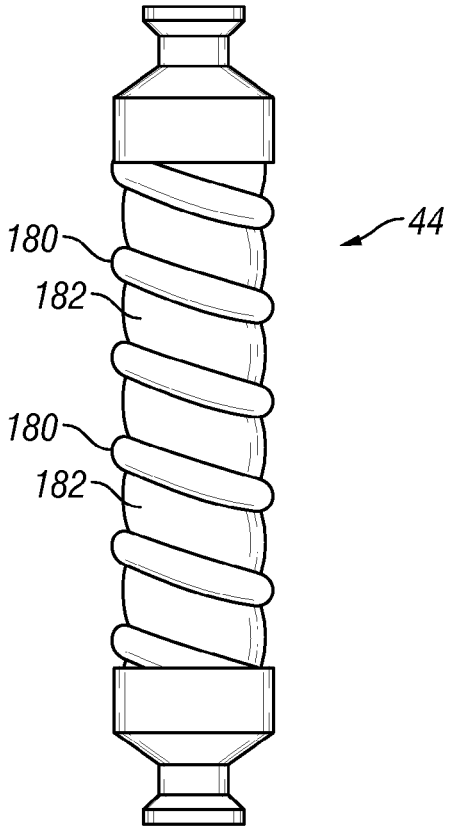
FIG. 3 is a side view of an embodiment of a plunger delivery system utilizing a coiled tube plunger with applied chemical treatment solution.
Figure 4:
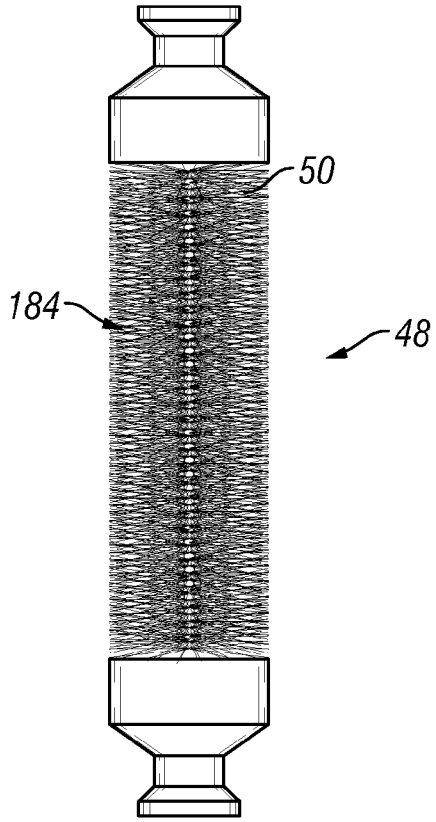
FIG. 4 is a side view of a brush plunger with applied chemical treatment solution.

FIGS. 3 and 4 illustrate yet other embodiments of chemical dispensers. These embodiments use known plungers as carriers for the chemicals. FIG. 3 illustrates a coiled tube plunger 44. The space between coiled member 180 of plunger 44 may be partially or completely filled with chemical 182. Chemical 182 may be take any one of a number of physical forms such as a paste, gel, or liquid, although in the case of a coiled tube plunger 44, chemical 182 in the form of a paste is especially advantageous as pastes generally have a consistency appropriate for packing into the space between the coil members 180. In FIG. 4, a wire brush plunger 48 that includes a brush portion 50 that may be impregnated with treatment chemical. The treatment chemical can be applied in the form of a spray, paste, or gel. Preferably, it has the consistency which will be retained on the brush as it falls through the tubing. The embodiments depicted in FIGS. 3 and 4 have the advantage of utilizing existing plungers as the delivery system. They have the disadvantage, however, that when the plunger comes to rest on the stop, the treatment chemical will be positioned in the tubing 14 (FIG. 1). Thus, the chemical must be dissolved within the tubing 14 (FIG. 1) and then migrate to the formation to provide treatment. The treatment chemical can be any known treatment chemical which can be pumped as described herein. Treatment chemicals which can be used include paraffin solvents, clay stabilizers, paraffin inhibitors, chelating agents, scale inhibitors, solvents, corrosion inhibitors, acid, and soap.

Yet another type of plunger suitable for use in connection with embodiments of the present disclosure include a bypass plunger (not shown). One suitable bypass plunger includes a bypass valve. The valve is open during a downstroke of the bypass plunger to reduce travel time to a bottom of a well. During the upstroke of the bypass plunger, a pressure differential across the valve keeps the valve closed to assist in pushing fluids to the surface. A spring in the valve opens the valve when the pressure differential decreases to below a selected value.

Figure 5:
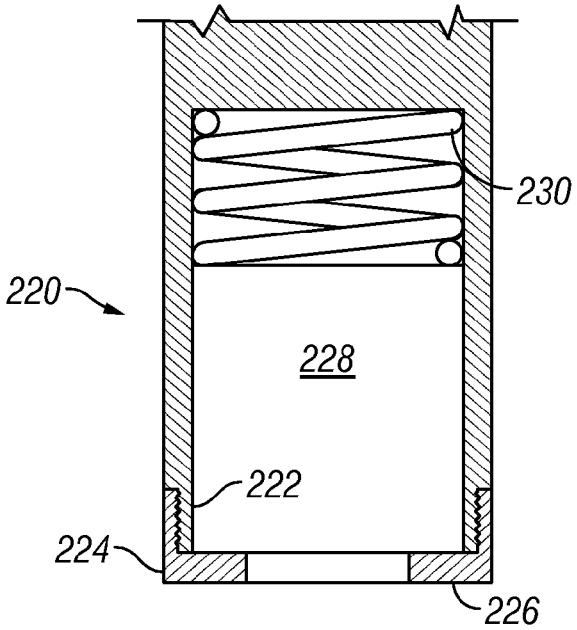
FIG. 5 is a partial cross-sectional view of an embodiment of a chemical dispenser suitable for use in a plunger delivery system.

Referring now FIG. 5, there is shown another embodiment of a chemical dispenser 220 for delivering a treatment chemical. The chemical dispenser 220 may include an opening 222 that is partially enclosed by a removable cap 224. The cap 224 includes a retaining lip 226 that extends inwardly to retain a chemical stick 228 within the chemical dispenser 220. A bias spring 230 forces the chemical stick 228 against the cap 224. During use, the lower portion of the chemical stick 228 is exposed to liquid at the bottom of the well via the partially enclosed opening 222. As the lower portion of the chemical stick 228 dissolves, the bias spring 230 pushes the remainder of the chemical stick 228 toward the opening 222.

Figure 8:
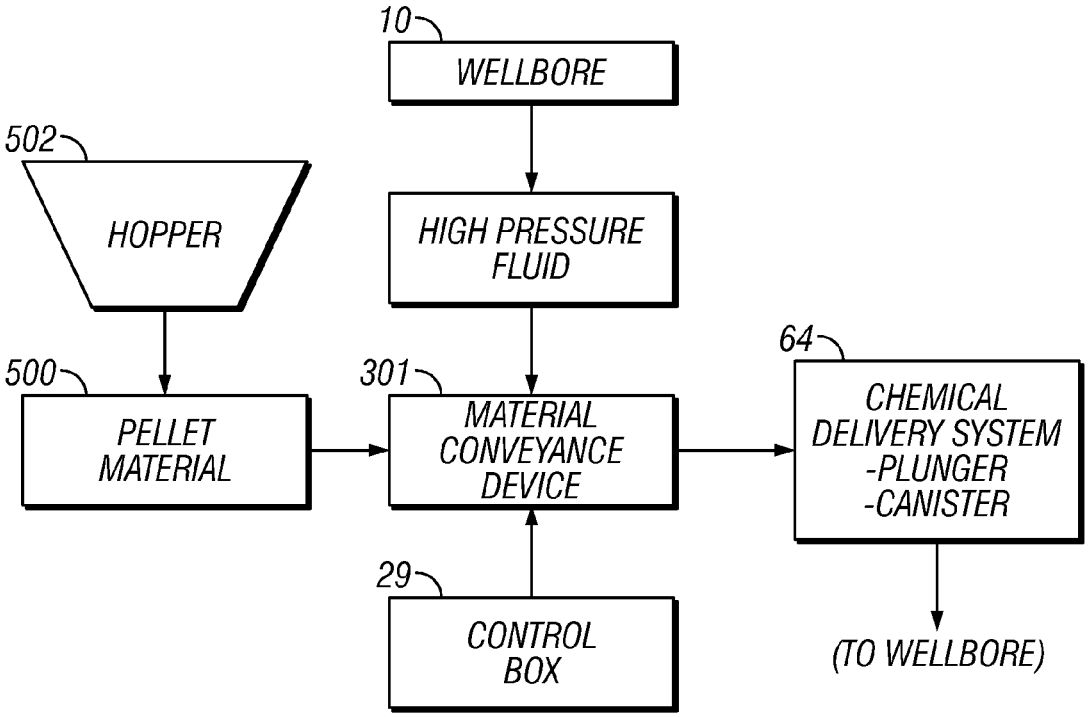
FIG. 8 schematically illustrates one embodiment of a material delivery system for delivering pellets made in accordance with the present disclosure.

Referring now to FIG. 8, there is shown an embodiment of a material conveyance device 301 that is energized by pressure variations in wellbore 10 in much the same manner as pump mechanism 300 (FIG. 1). The material conveyance device 301 receives one or more pellets 500 from a supply source such as a hopper 502. In one embodiment, the hopper 502 may utilize a flow device such as a pneumatic blower (not shown) to flow the pellet material 500 to the material conveyance device 301. Some pellet material, such as time release capsules, may be delivered without being dissolved or slurried. Other pellet material may be immersed, dissolved and/or slurried in a liquid or aqueous solution such as alcohol or liquid hydrocarbon. Upon being loaded into the material conveyance device 301, the pellet material 500 may be expelled or otherwise delivered to the chemical delivery system 65 for insertion into a delivery device such as a plunger or canister. As described previously, pump mechanism 300 (FIG. 1) applies pressure to expel material from the treatment chemical chamber 440 (FIG. 6). A similar applied pressure may also be utilized by the material conveyance device 301 to move the pellet material 500. In other embodiments, the translation or movements of a piston, such as pistons 320 and/or 330 (FIG. 6) may be used to push the pellet material 500 toward the chemical delivery system 65. Control box 29 may be programmed to control one or more aspects of the operation of the material conveyance device 301 and associated systems.

Figure 9:
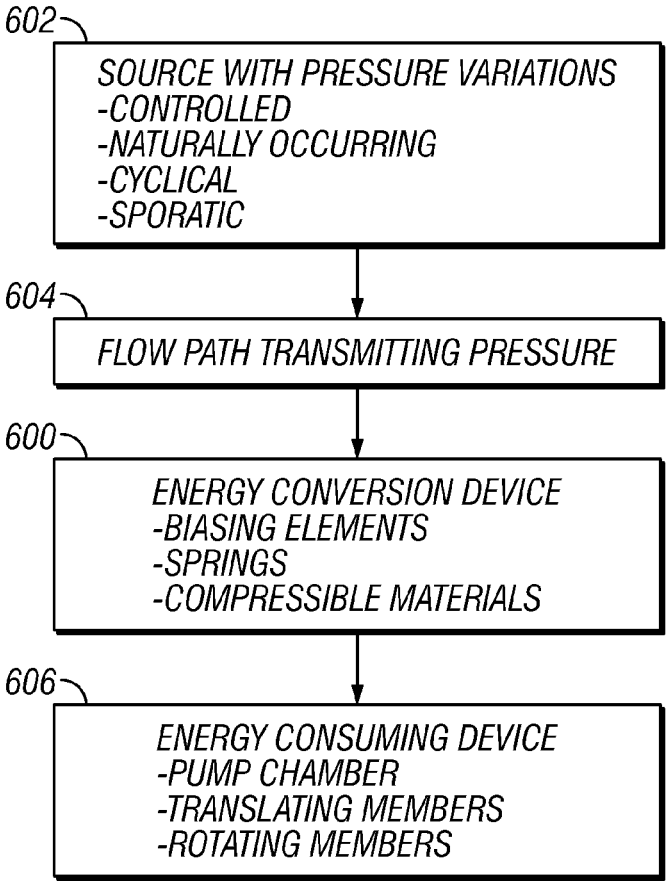
FIG. 9 functionally illustrates one embodiment of a system utilizing pressure variations from a source and made in accordance with the present disclosure.

Referring now to FIG. 9, there is functionally illustrated an exemplary system 600 that utilizes pressure variations as an energy source. As should be appreciated, a suitable source 602 for energizing the system 600 need only have some form of pressure variation. While a hydrocarbon producing well has been previously described as a suitable source 602, other sources 602 may include valves, subsea or surface flow lines, compressors, equipment having cyclical or intermittent operations, etc. The system 600 may be coupled to the source 602 via a suitable pressure communicating conduit 604. The conduit 604 may supply a high pressure fluid and, optionally, a low pressure fluid. As discussed previously, a low pressure fluid may be supplied by a separate source (not shown). The system 600 converts a pressure differential between a high pressure supplied by the source 602 and a low pressure into an energy storable in a medium such as a biasing member, compressible gas, etc. When desired, the system 600 releases the stored energy via an associated device 606 to reduce a volume of a chamber, translate/rotate an element or member, or otherwise perform a desired function. Exemplary non-limiting examples of suitable sources are shown in FIGS. 10 and 11.

Figure 10:
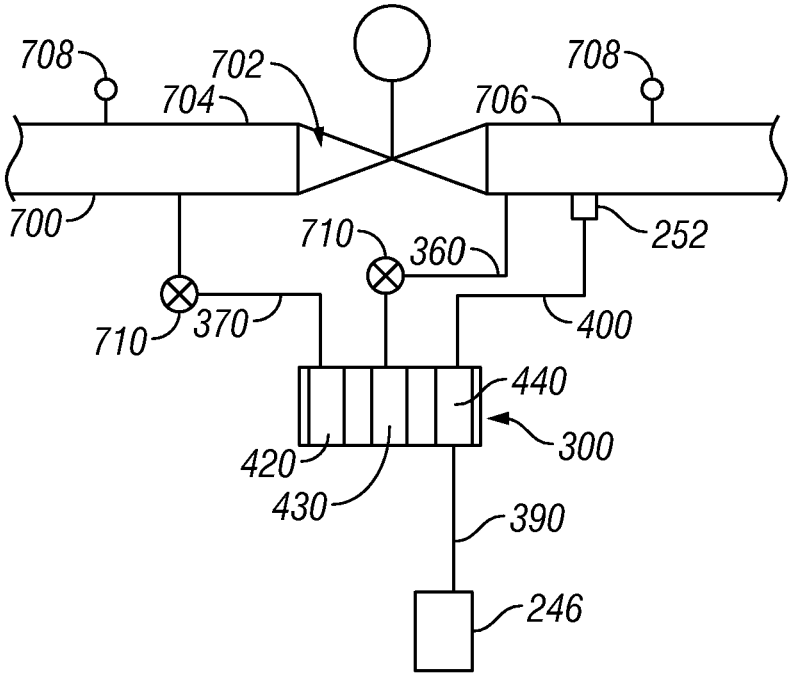
FIG. 10 schematically illustrates one embodiment of a system utilizing pressure variations from a fluid conduit source having a flow control device.

Referring now to FIG. 10, there is shown an application wherein a source is a fluid conduit 700 having a flow control device 702. An exemplary fluid conduit 700 may include, but is not limited to, a surface pipeline, a subsea fluid conduit, or a conduit associated with a facility such as a manufacturing or processing facility. The flow control device 702 may be any device that creates a pressure differential between a location 704 upstream of the flow control device 702 and a location 706 downstream of the flow control device 702. Exemplary flow control devices include, but are not limited to, valves, expanders, compressors and pumps. Parameters of interest, such as pressure, temperature, flow rates, etc., may be measured using suitable sensors 708. Sensors 708 may also provide a measure of characteristics of a fluid in the fluid conduit 700, which may include a direct or indirect measurement of paraffins, hydrates, sulfides, scale, asphaltenes, fluid phases, emulsion, etc. While activated, the flow control device 702 causes the pressure at point 704 to be higher than the pressure at point 706. When the flow control device 702 is deactivated, the pressure at point 704 drops. Thus, the activation and deactivation of the flow control device 702 causes a pressure variation in the flow line 700. It should be appreciated that in this application, the pressure variation is contingent upon a controllable event, i.e., operation of the flow control device 702, rather than contingent on a natural or environmental condition, e.g., pressure increase in a well. This pressure variation may be used to energize the pump 300.

In a manner similar to that previously described, the pump 300 may be energized using pressure variations caused by the activation and deactivation of the flow control device 702. In one embodiment, pump 300 includes a high pressure gas chamber 420 in fluid communication with the fluid conduit 700 at or near point 704 via line 370, a low pressure chamber 430 in fluid communication with the fluid conduit 700 at or near point 706 via line 360, and a treatment chemical chamber 440 in fluid communication with the fluid conduit 700 via line 400. Of course, a low pressure source 362 (FIG. 6) may also be used in addition to or in lieu of the line 360. The treatment chemical chamber 440 receives one or more materials from a supply 246 via line 390 and may deliver the materials at or near point 706 or some other location. In some embodiments, the supply 246 supplies a hydrate inhibiting agent. Directional check valves 710 may be incorporated into the lines in fluid communication with pump mechanism 300 to ensure a desired direction of flow. The other elements of the pump 300 have been previously discussed and will not be repeated. While the flow control device 702 is activated, the pressure differential between points 704 and 706 enables the pump 300 to charge the treatment chemical chamber 440 with a material such as a hydrate inhibiting agent in a manner previously described. When the flow control device 702 is deactivated, the pressure at point 704 drops, which allows the pump 300 to deliver the material into the fluid conduit 700 via line 400. An applicator 252 may be used to assist in delivering the material into the fluid conduit 700.

Figure 11:
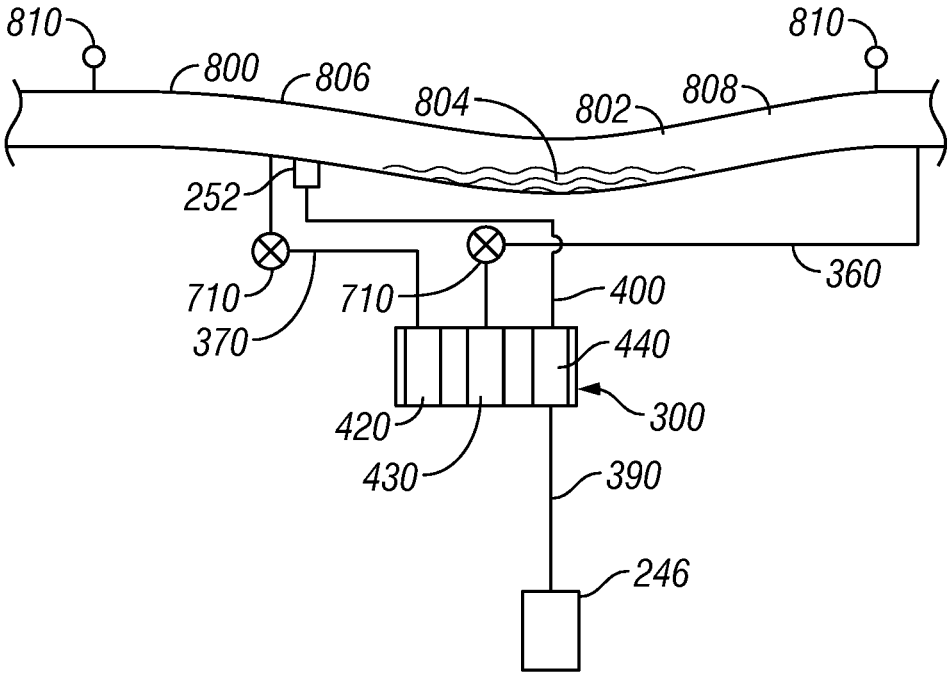
FIG. 11 schematically illustrates one embodiment of a system utilizing pressure variations from a fluid conduit source having a section susceptible to fluid slugging.

Referring now to FIG. 11, there is shown another source that is a fluid conduit 800 having a section 802 wherein a fluid 804 may collect. As described earlier, exemplary fluid conduits 800 include, but are not limited to, a surface pipeline, a subsea flowline, or a conduit associated with a facility such as a manufacturing or processing facility. As described previously, parameters of interest, such as pressure, temperature, flow rates, and chemical characteristics of a fluid in the flowline 800 may be measured using suitable sensors 810. Also, directional check valves 710 may be incorporated into the lines in fluid communication with pump mechanism 300 to ensure a desired direction of flow. Periodically or intermittently, the accumulated fluid 804 may restrict the cross-sectional flow area at the section 802 such that a pressure differential may arise between a location 806 upstream of the section 802 and a location 808 downstream of the section 802. This flow restriction causes the pressure at point 806 to be higher than the pressure at point 808. At some point, the pressure differential reaches a magnitude sufficient to displace the fluid 804. Upon displacement of the fluid 804, the pressure at point 806 drops. Thus, the accumulation and eventual displacement of the fluid 804 causes a pressure variation in the flow line 800. It should be appreciated that in this application, the pressure variation is contingent upon a naturally occurring event, i.e., the formation of fluid slugs 804, rather than contingent on an induced or controlled event, e.g., operation of a valve. This pressure variation may also be used to energize the pump 300.

In a manner similar to that previously described, the pump 300 that may be energized using pressure variations caused by the accumulation and displacement of the fluid 804. The accumulated fluid is sometimes referred to as a fluid slug. For gas flow, liquid slugs may form at valleys or low points in a conduit whereas for liquid flow, gas slugs may develop at peaks high points in a conduit. The various elements of the pump 300 have been previously discussed and will not be repeated. In one embodiment, pump 300 includes a high pressure gas chamber 420 in fluid communication with the flowline 800 at or near point 806 via line 370, a low pressure chamber 430 in fluid communication with the flowline 800 at or near point 808 via line 360, and a treatment chemical chamber 440 in fluid communication with the flowline 800 via line 400. Of course, a low pressure source 362 (FIG. 6) may also be used. The treatment chemical chamber 440 receives one or more materials from a supply 246 via line 390 and may deliver the materials at or near point 806 or some other location. In some embodiments, the treatment chemical chamber 440 includes a hydrate inhibiting agent. Directional check valves 710 may be incorporated into lines in fluid communication with pump mechanism 300 to ensure a desired direction of flow. As the fluid 804 accumulates, the pressure differential between points 806 and 808 enables the pump 300 to charge the treatment chemical chamber 440 with a material such as a hydrate inhibiting agent. After the fluid 804 is displaced, the pressure at point 806 drops, which allows the pump 300 to deliver the material into the flowline 800. An applicator 252 may be used to assist in delivering the material into the flowline 800.

From the above, it should be appreciated that embodiments of the present disclosure may utilize a pump mechanism that is driven by variations in the pressure found in the pressurized sources to which it is connected. The pump mechanism may be connected to and driven by any one of a number of gaseous or fluid sources so long as the source or sources to which it is connected experience variations in pressure, whether such variations are naturally occurring or controlled. It should also be appreciated that the pump may deliver a material into a pressurized environment. That is, flowlines or wells may have an operating pressure greater than atmospheric pressure. Nevertheless, embodiments of pumps can deliver a material such as a liquid or pellet into the pressurized environment by making use of pressure variations as described above.

Further, it should be understood that FIG. 6 illustrates merely one non-limiting embodiment of an arrangement of a pump. The use of elements such as pistons, connecting members, chambers, etc. and the relative positioning of such elements are susceptible to various embodiments. Illustrative non-limiting embodiments of some arrangements for the pump 300 are shown in FIGS. 12 and 13.

Figure 12:
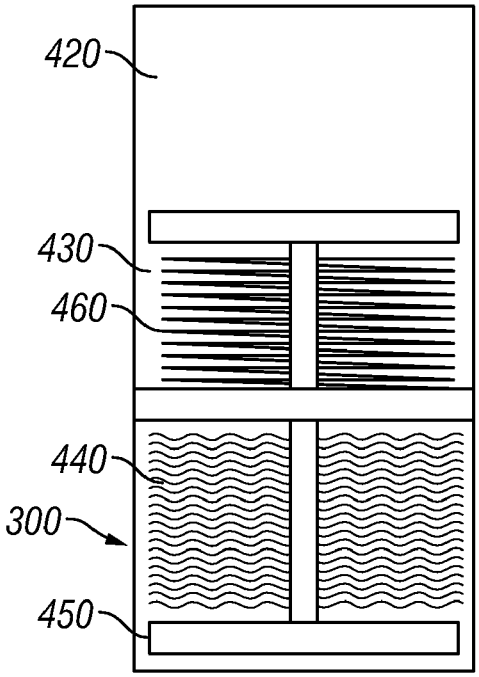
FIG. 12 schematically illustrates one embodiment of a pump wherein a biasing member is positioned in a low pressure chamber.

In FIG. 12, the pump 300 includes a high pressure gas chamber 420, a low pressure chamber 430, a treatment chemical chamber 440, and a biasing element 460 such as a spring. As can be seen, the biasing element 460 is positioned in the low pressure chamber 430 rather than the ambient chamber 450. This may be advantageous in that the biasing member 460 may be protected from corrosion when surrounded by a gas such as nitrogen. In a variant of FIG. 11 that is not shown, the biasing element 460 (FIG. 6) is not used. Rather, the low pressure source 362 furnishes sufficient resistive force to fully discharge the pump 300. Applications where the biasing element 460 may be omitted may include instances where the magnitude of the pressure variation is sufficiently large enough to pressurize the low pressure chamber 430 to allow the pump 300 to discharge the contents of the treatment chemical chamber 400. Factors bearing on whether the pressure variation is sufficiently large may include the viscosity of the material to be discharged and the time period within which the material is to be discharged. For instance, if the pressure variation is sufficiently large, the material to be delivered is not viscous and a large time period is available for delivering the material, then the low pressure gas, which has been compressed during the charging phase, may alone provide the force required to evacuate the treatment chemical chamber 440.

Figure 13:
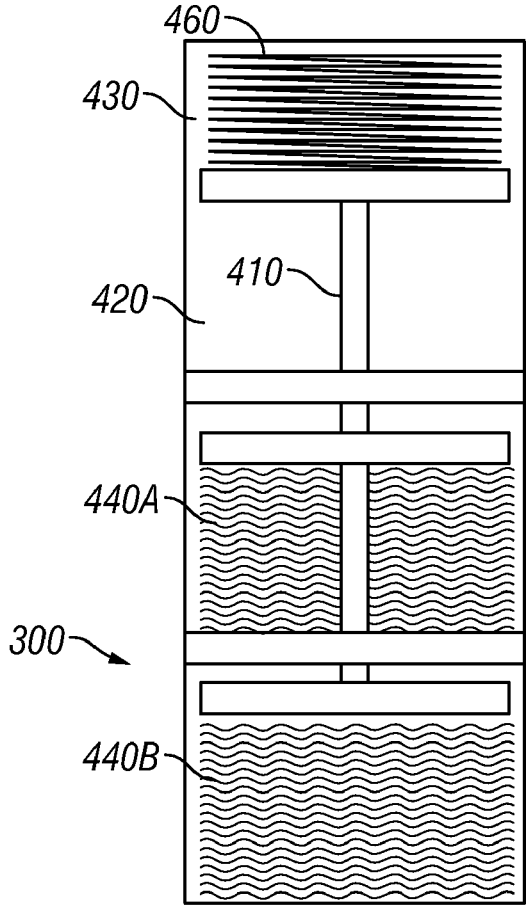
FIG. 13 schematically illustrates one embodiment of a pump that delivers two or more materials.

In FIG. 13, the pump 300 includes a high pressure gas chamber 420, a low pressure chamber 430, a first treatment chemical chamber 440A, a second treatment chemical chamber 440B, and a biasing element 460. As can be seen, the pump can deliver two materials into a desired location. Of course, additional treatment chemical chambers may be added if desired. Furthermore, the high pressure chamber 420 is positioned between the low pressure chamber 430 and the treatment chemical chambers 440A and 440B. Further, the biasing element 460 is positioned in the low pressure chamber 430. The pump 300 of FIG. 13 may be utilized to deliver the same material or two or more different materials. Further, the pump 300 may utilize a mixing device (not shown) to mix two or more materials prior to delivery.

Embodiments of the present disclosure may be advantageously applied in the area of petroleum production and to wells which require the periodic application of chemicals used to treat the well or flow line. The pump mechanisms of the present disclosure may be used in any number of applications in and around the petroleum producing industry, such as for example, but without limitation, the injection of chemicals, fluids and/or lubricants into a wellhead, flow line, vessel, gathering or transportation system. Moreover, embodiments of the present disclosure may be utilized in a variety of hydrocarbon-producing wells, such as oil and/or gas producing wells, generally without regard to production levels or well geometry, including stripper wells, deviated wells, and wells utilizing artificial lift techniques. As described, the pump mechanism may operate by utilizing pressure changes found in a wellbore, but may also take advantage of pressure differentials and pressure swings across, for example, valves.

Although much of the above-descriptions referred to vertical gas wells and wells using plunger lift technology, those conditions should not be taken as a limitation on the applicability of the present disclosure, and any reference to the term "well" should be understood as applying to the broadest applicable range of physical, geological, and/or production characteristics, including all apparatus appurtenant to the well such as all production equipment, vessels, and transportation lines. Furthermore, it should be understood that although embodiments of the present disclosure has been described in relation to a single pumping mechanism delivering a single treatment chemical, alternate embodiments in which multiple pumping mechanisms deliver multiple treatment chemicals in connection with a single well are possible. For example, in some wells, it may be desirable to treat paraffin deposits located at a relatively shallow depth within well 10 with a paraffin inhibitor, while also treating corrosion located at greater depths within well 10 with a corrosion inhibitor.

Although the disclosure has been disclosed and described in relation to its preferred embodiments with a certain degree of particularity, it is understood that the present disclosure of some preferred forms is only by way of example and that numerous changes in the details of construction and operation and in the combination and arrangements of parts may be resorted to without departing from the scope of the disclosure as claimed here.

The invention claimed is:

1. A method of delivering a selected material into a hydrocarbon producing well where hydrocarbons are produced from the well into a production line wherein the method utilizes the pressure of the well, the method comprising:

a) delivering hydrocarbon gas from the hydrocarbon producing well at a pressure greater than ambient surface pressure into a first chamber associated with a pump mechanism;

b) drawing a selected material into a second chamber associated with the pump mechanism that the pressure of the hydrocarbon gas being delivered into the first chamber associated with the pump mechanism causes the selected material to be drawn into the second chamber and storing the energy associated with the high pressure hydrocarbon gas;

c) producing hydrocarbon gas from the well to the production line and thereby allowing the pressure of the well to reduce; and d) releasing the stored energy associated with the high pressure hydrocarbon gas in the pump mechanism and thereby delivering the selected material from the second chamber into the well.

2. The method according to claim 1 further comprising periodically shutting-in the well to increase pressure in the well; and opening the well to decrease pressure in the well.

3. The method according to claim 1 further comprising directing the flow of the selected material out of the second chamber to a plunger positioned to traverse the well.

4. The method of claim 3, wherein the plunger is one selected from the group consisting of: (i) a bypass plunger, (ii) a coiled tube plunger, (iii) a brush plunger, and (iv) a canister having a chamber receiving the selected material.

5. The method of claim 1, wherein the selected material is one selected from the group consisting of (i) a pellet, (ii) a liquid, (iii) a slurry, (iv) a gel, and (v) an atomized liquid.

6. The method according to claim 1 wherein the selected material is a hydrate inhibiting agent.

7. The method according to claim 1 wherein the pump mechanism includes an energy storage element and wherein the energy storage element is one of: (i) a compressible fluid, (ii) a biasing member, and (iii) a spring member.

8. The method according to claim 1 further including providing the selected material in a container and wherein the container is one selected from the group consisting of: (i) a hopper configured to receive pellets, and (ii) a tank configured to receive a fluid.

9. The method according to claim 1 further including providing a dispensing conduit in communication with the second chamber.

10. The method according to claim 9 wherein a plunger is arranged for receiving the selected material from the dispensing conduit and for conveying the selected material into a well.

* * * * *